US011381013B2

(12) United States Patent
Hsu

(10) Patent No.: US 11,381,013 B2
(45) Date of Patent: Jul. 5, 2022

(54) ELECTRICAL CONNECTOR

(71) Applicants: FUDING PRECISION COMPONENTS (SHENZHEN) CO., LTD., Shenzhen (CN); FOXCONN INTERCONNECT TECHNOLOGY LIMITED, Grand Cayman (KY)

(72) Inventor: Shuo-Hsiu Hsu, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 51 days.

(21) Appl. No.: 16/914,459

(22) Filed: Jun. 28, 2020

(65) Prior Publication Data

US 2020/0412037 A1 Dec. 31, 2020

(30) Foreign Application Priority Data

Jun. 28, 2019 (CN) ..... 201910577428.5

(51) Int. Cl.
*H01R 13/24* (2006.01)
*H01R 12/71* (2011.01)
*H01R 12/57* (2011.01)

(52) U.S. Cl.
CPC ..... *H01R 12/716* (2013.01); *H01R 12/57* (2013.01); *H01R 13/2407* (2013.01)

(58) Field of Classification Search
CPC .. H01R 12/716; H01R 12/57; H01R 13/2407; H01R 12/7082; H01R 13/2442; H01R 12/7076; H01R 13/40; H01R 13/24
See application file for complete search history.

(56) References Cited

U.S. PATENT DOCUMENTS

| | | | | |
|---|---|---|---|---|
| 8,235,734 | B2 * | 8/2012 | Ju | H01R 12/57 439/83 |
| 10,230,177 | B2 | 3/2019 | Lotes | |
| 10,535,946 | B2 * | 1/2020 | Ho | H01R 13/17 |
| 10,601,163 | B2 * | 3/2020 | Ju | H01R 12/7076 |
| 10,833,441 | B2 * | 11/2020 | Hsu | H01R 4/02 |
| 2013/0237066 | A1 * | 9/2013 | Yeh | H05K 7/10 439/65 |

(Continued)

FOREIGN PATENT DOCUMENTS

TW M578031 U 5/2019

*Primary Examiner* — Abdullah A Riyami
*Assistant Examiner* — Nelson R. Burgos-Guntin
(74) *Attorney, Agent, or Firm* — Ming Chieh Chang; Wei Te Chung

(57) ABSTRACT

A connector includes an insulative housing having opposite upper and lower surfaces with a plurality of passageways extending therethrough, and a plurality of contacts retained in the corresponding passageways, respectively. Each contact includes a primary part and a secondary part discrete from each other. The primary part includes a first main body with a first spring arm extend upwardly through the upper surface for mating with the CPU, and a first soldering section around the lower surface. The secondary part includes a second main body with a second spring arm contacting the first main body, and a second soldering section around the lower surface. A solder ball is attached to the first soldering section and/or the second soldering section.

14 Claims, 7 Drawing Sheets

(56) References Cited

U.S. PATENT DOCUMENTS

| | | | | |
|---|---|---|---|---|
| 2014/0134882 | A1* | 5/2014 | Terhune, IV | H01R 13/2407 439/626 |
| 2018/0212347 | A1* | 7/2018 | Chang | H01R 4/02 |
| 2019/0334273 | A1* | 10/2019 | Hsu | H01R 13/15 |
| 2020/0052429 | A1* | 2/2020 | Hwang | H01R 43/20 |
| 2020/0176912 | A1* | 6/2020 | Hsu | H01R 13/2442 |
| 2020/0412037 | A1* | 12/2020 | Hsu | H01R 12/57 |
| 2021/0021067 | A1* | 1/2021 | Hsu | H01R 12/91 |
| 2021/0091490 | A1* | 3/2021 | Hsu | H05K 7/1061 |
| 2021/0203091 | A1* | 7/2021 | Hwang | H01R 12/585 |

* cited by examiner

ELECTRICAL CONNECTOR

BACKGROUND OF THE INVENTION

1. Field of the Invention

The present invention relates generally to an electrical connector, and particularly to the electrical connector equipped with a plurality of contacts each having a primary part and a secondary part mutually discrete from while mechanically and electrically connected to each other wherein the primary part and the secondary part have optionally different conductivities and thicknesses from each other.

2. Description of Related Arts

Taiwan Patent No. TWM578031 discloses an electrical connector for use between a CPU (Central Processing Unit) ad a PCB (Printed Circuit Board). On one hand, the number of the contacts gets more and more so as to increase the mating normal force, i.e., the total reaction forces of all the contacts against the CPU. To avoid the undesired increased mating force, it tends to lower the reaction force of each contact by lessening the width and/or the thickness of each contact. On the other hand, the delivery power of the whole connector will be increased to meet the high speed transmission. To comply with the high power, it tends to increase the thickness and width of each contact for transmission consideration. Notably, such a conflict situation can not be solved by the current contact design.

It is desired to provide an electrical connector having the large number of the contacts for high power transmission while avoiding the undesired large reaction normal force during mating.

SUMMARY OF THE INVENTION

To achieve the above object, an electrical connector for connecting a CPU to a printed circuit board. The connector includes an insulative housing having opposite upper and lower surfaces with a plurality of passageways extending therethrough, and a plurality of contacts retained in the corresponding passageways, respectively. Each contact includes a primary part and a secondary part discrete from each other. The primary part includes a first main body with a first spring arm extend upwardly through the upper surface for mating with the CPU, and a first soldering section around the lower surface. The secondary part includes a second main body with a second spring arm contacting the first main body, and a second soldering section around the lower surface. A solder ball is attached to the first soldering section and/or the second soldering section.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
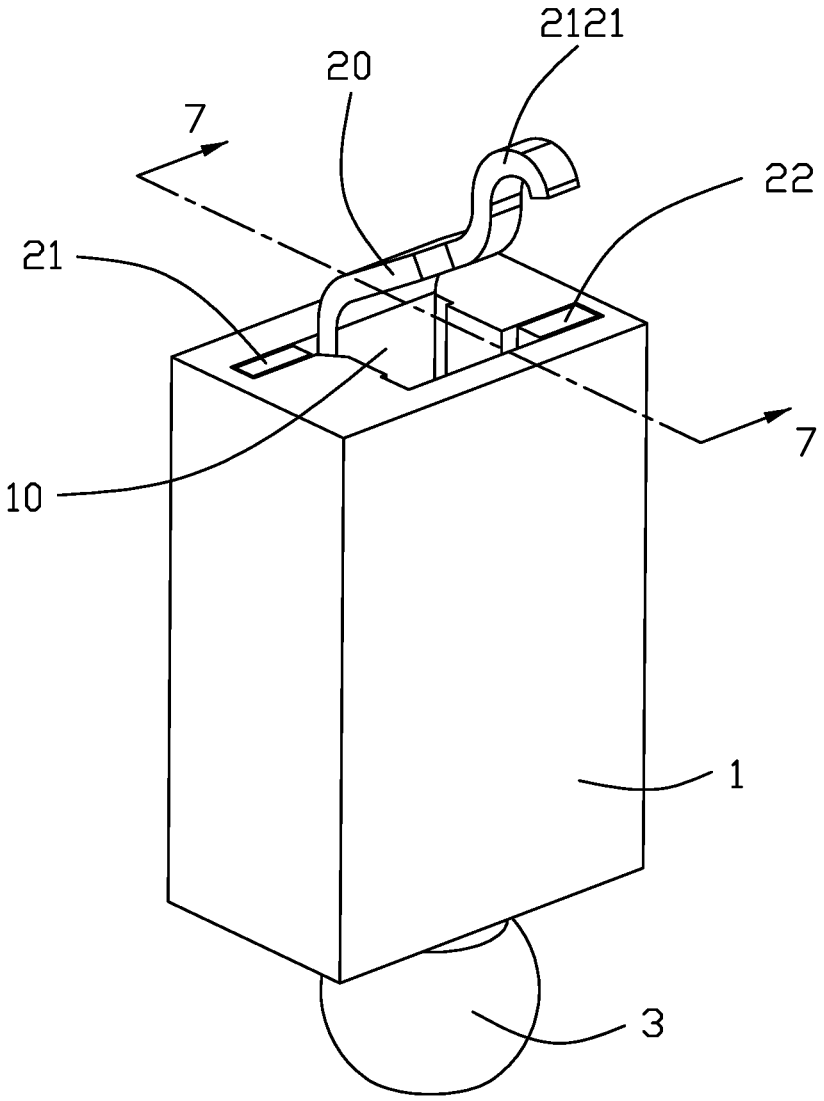
FIG. 1 is a perspective view of an electrical connector according to a preferred embodiment of the invention.
Figure 2:
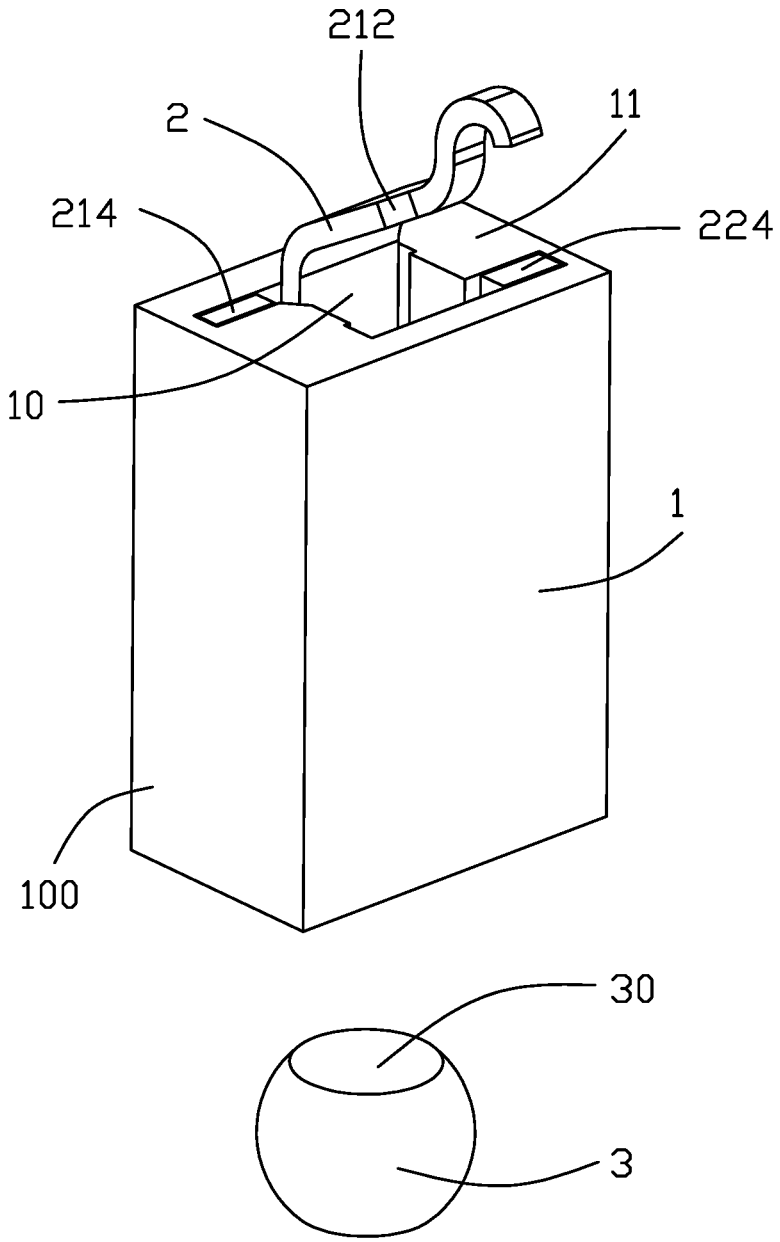
FIG. 2 is a perspective view of the electrical connector of FIG. 1 wherein the solder ball is removed away from the corresponding soldering sections.
Figure 3:
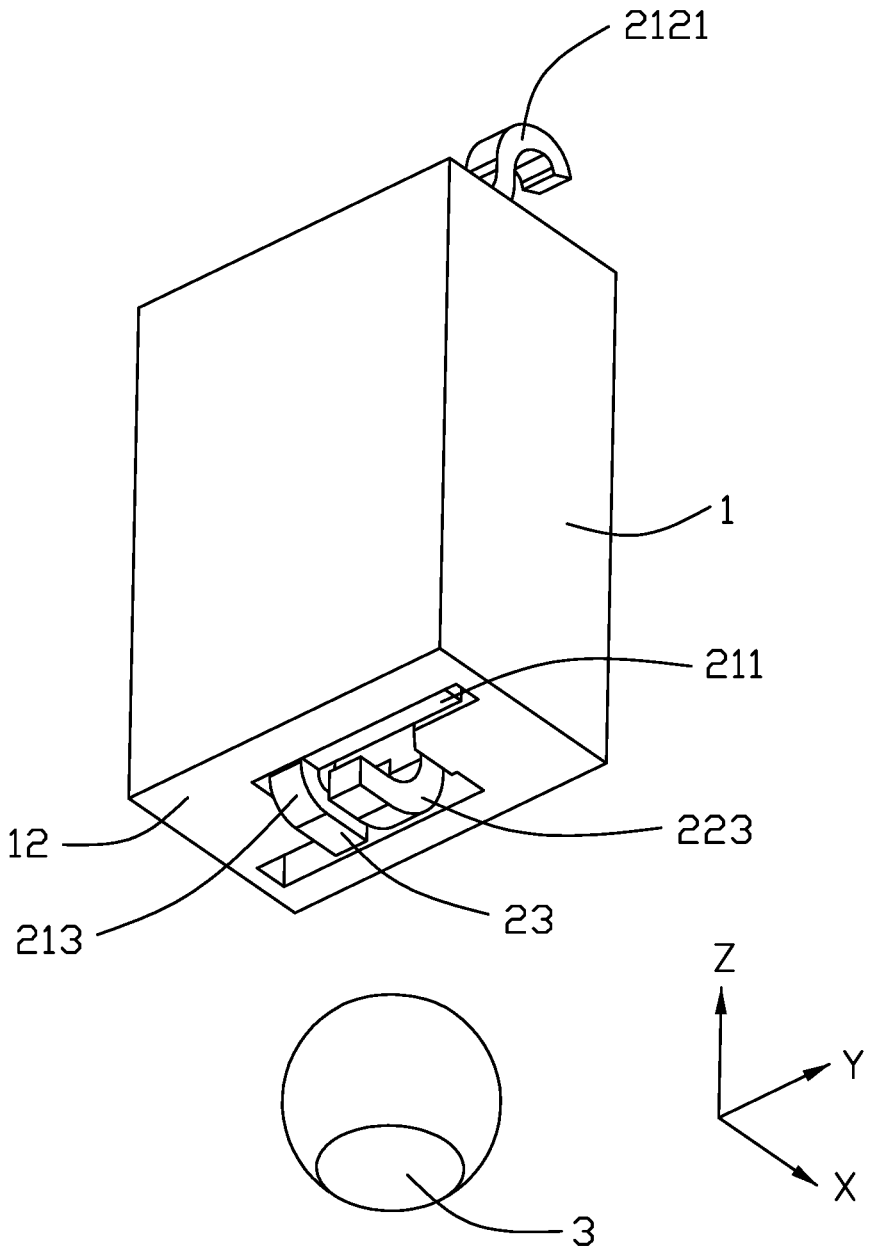
FIG. 3 is another perspective view of the electrical connector of FIG. 2.
Figure 4:
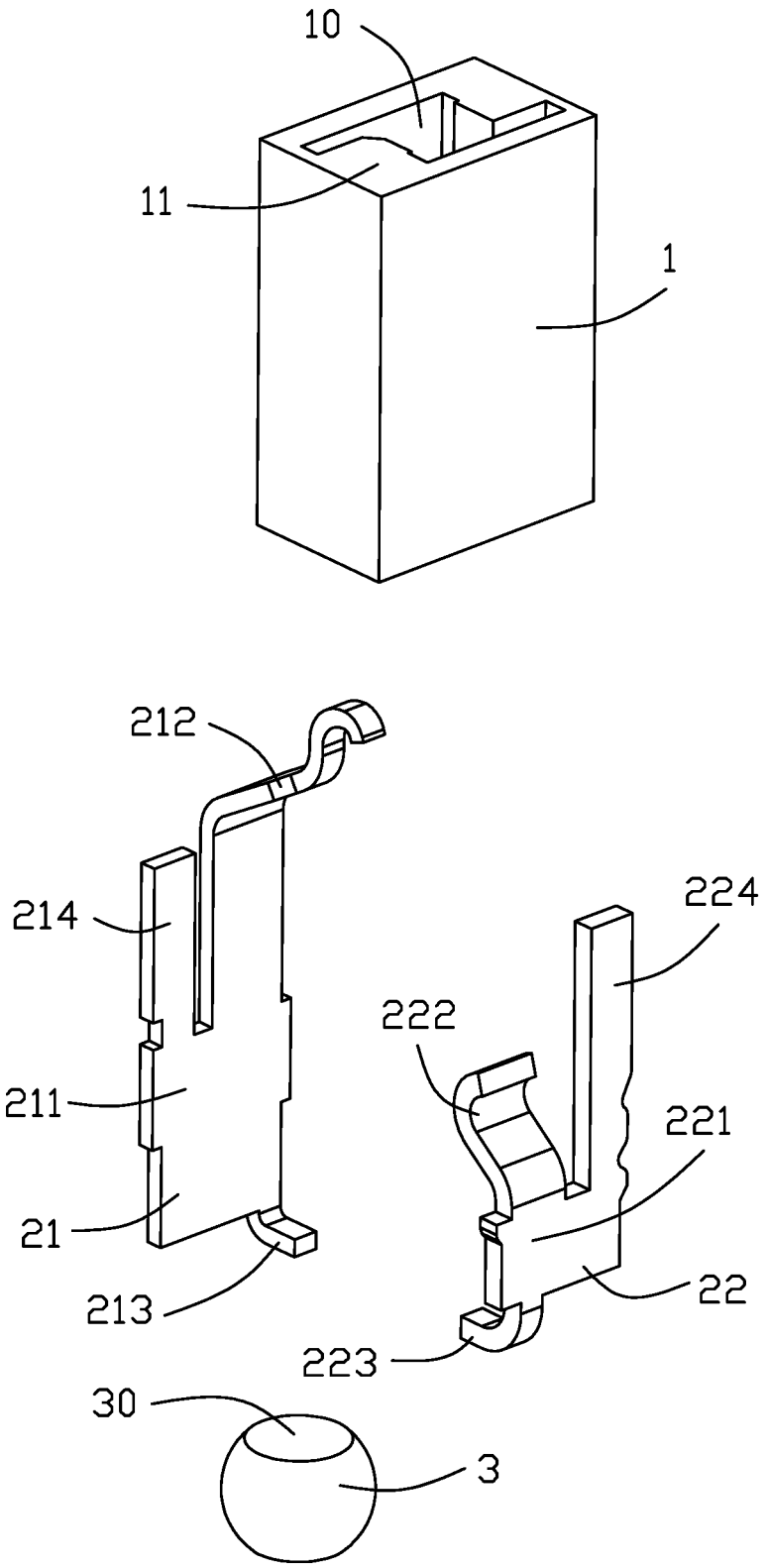
FIG. 4 is an exploded perspective view of the electrical connector of FIG. 2.
Figure 5:
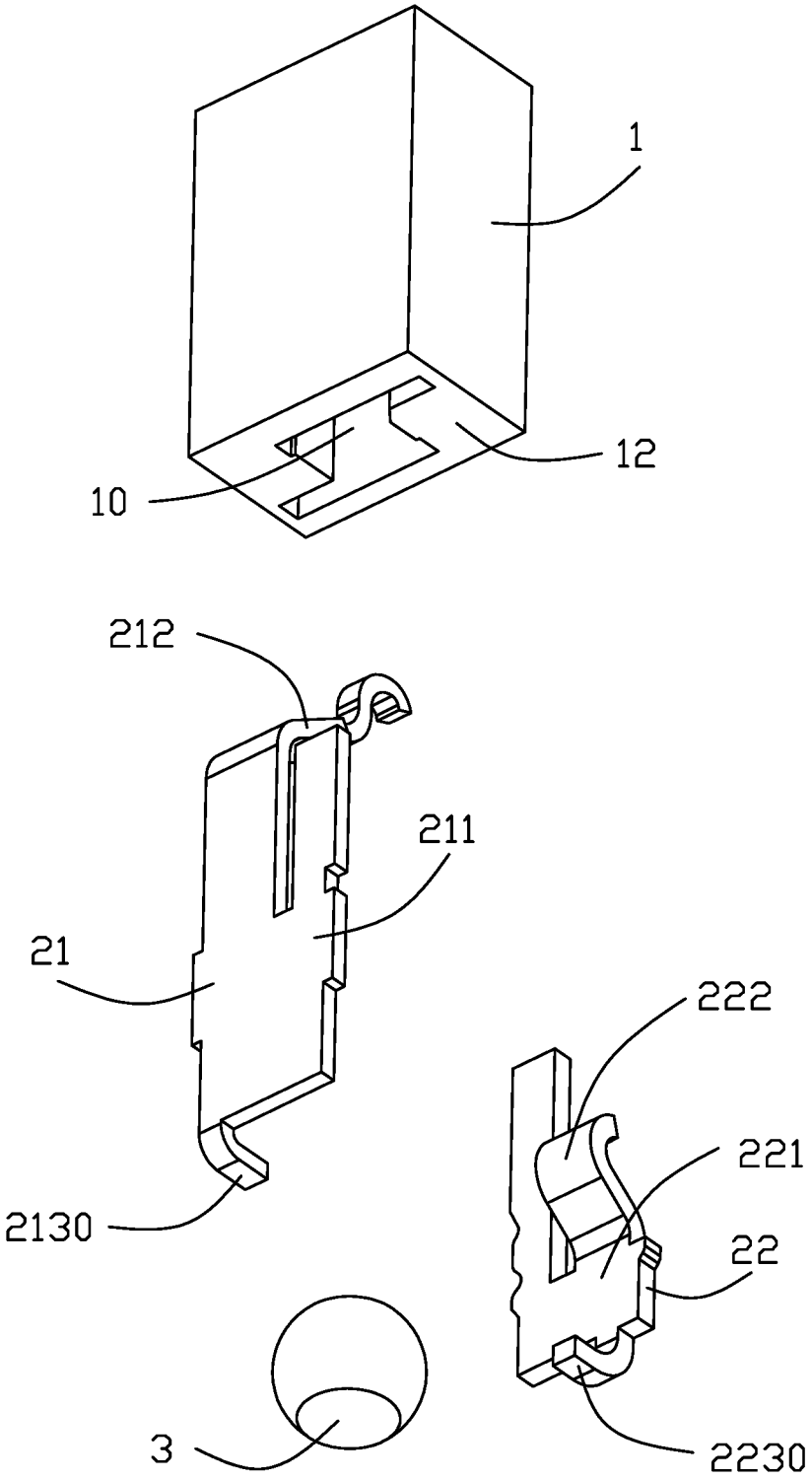
FIG. 5 is another exploded perspective view of the electrical connector of FIG. 4.
Figure 6:
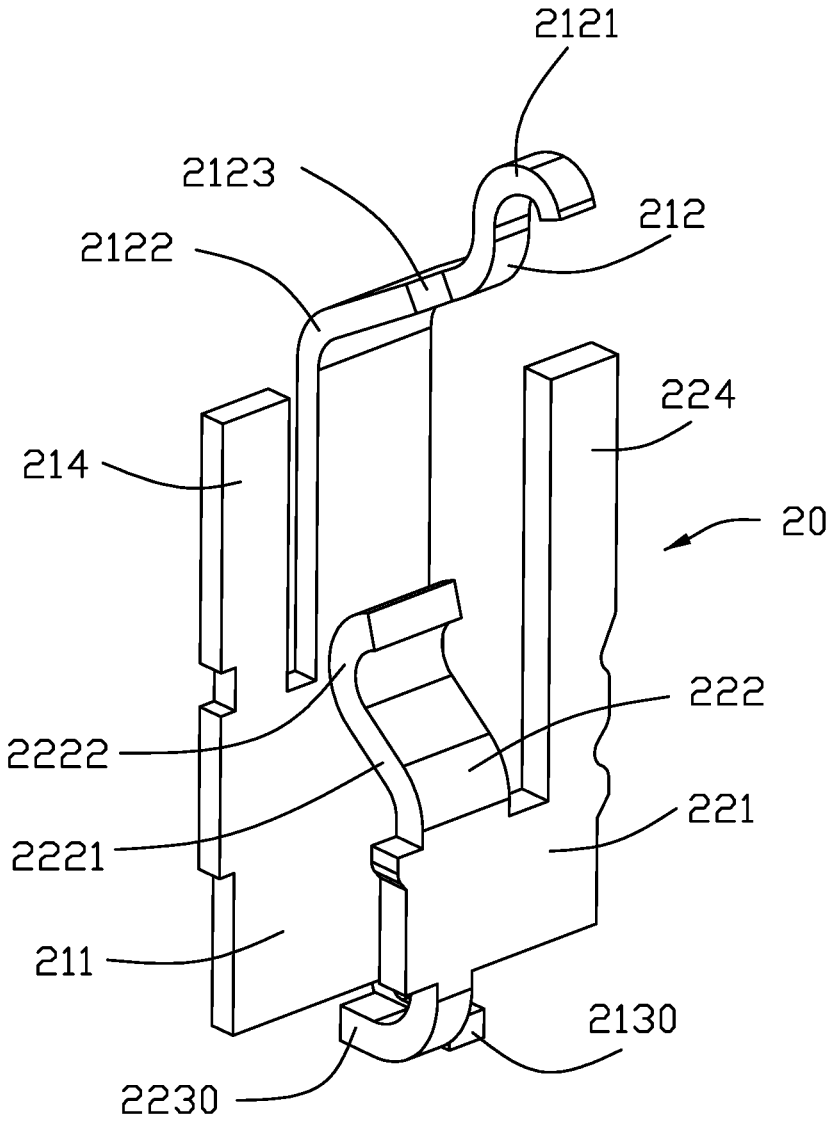
FIG. 6 is a perspective view of the contact of the electrical connector of FIG. 4.
Figure 7:
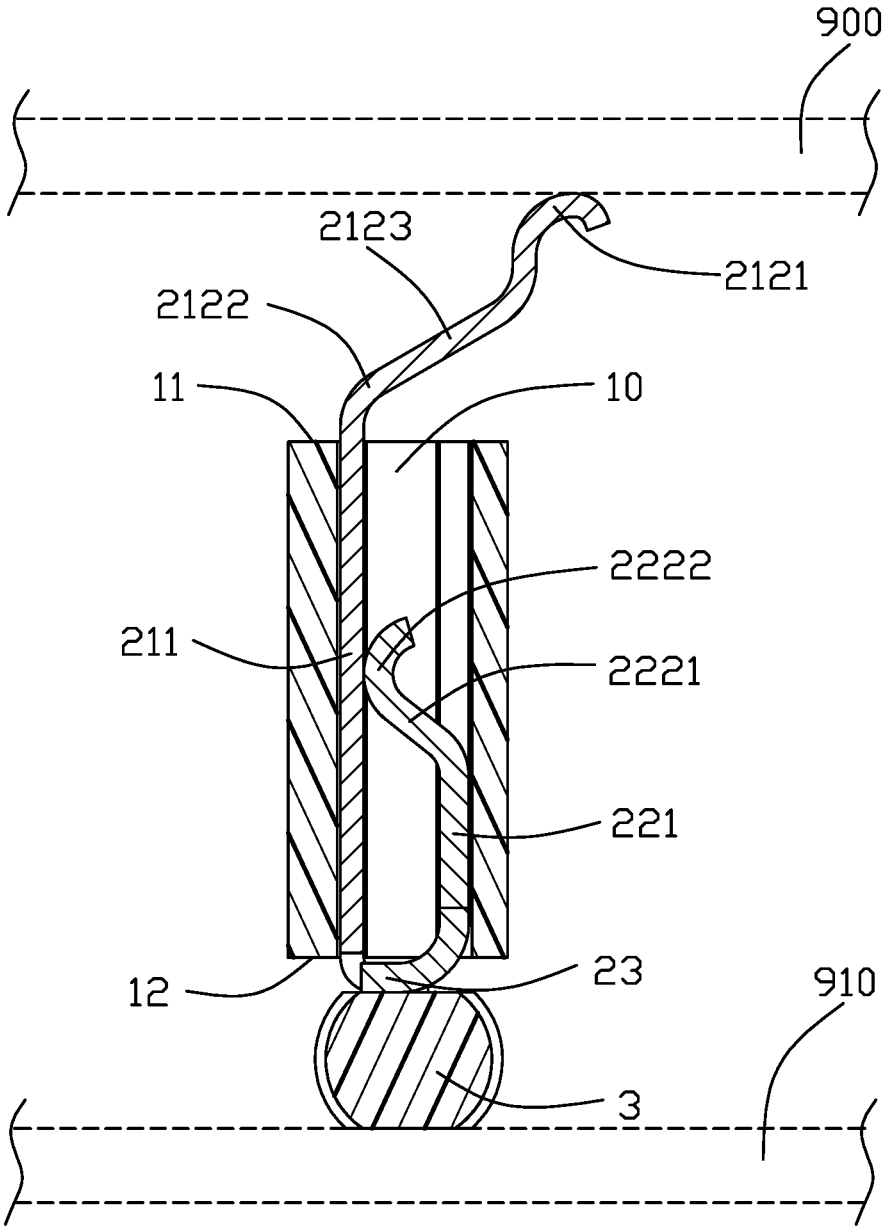
FIG. 7 is a cross-sectional view of the electrical connector of FIG. 1.

As shown in FIGS. 1-7, an electrical connector 100 for connection between a CPU 900 and a PCB 910, includes an insulative housing 1 forming a plurality of passageways 10 (only one shown) extending through both opposite upper surface 11 and lower surface 12 of the housing 1 in the vertical direction Z. A plurality of contacts 2 (only one shown) are retained in the corresponding passageways 10, respectively. At least one contact 2 includes a primary/mating part 21 and a secondary/soldering part 22 mutually discrete from each other while commonly received with the same corresponding passageway 10 and electrically and mechanically connected to each other. In this embodiment, the secondary part 22 has a higher conductivity than the primary part 21, and the secondary part 22 is thicker than the primary part 21. The primary part 21 includes a first main body 211, a first spring arm 212 extending from an upper portion of the first main body 211 and above the upper surface 11 with the corresponding contacting section 2121 for contacting the CPU 900, and a first soldering/mounting leg 213 extending from a lower portion of the first main body 211 around the lower surface 12.

The secondary part 22 includes a second main body 221, a second spring arm 222 extending from an upper portion of the second main body 221 toward to contact the first main body 211, and a second soldering/mounting leg 223 extending from a lower portion of the second main body 221 around the lower surface 12. In this embodiment, the first main body 211 and the second main body 221 are spaced from each other in the first horizontal direction X perpendicular to the vertical direction Z while the first soldering leg 213 and the second soldering leg 223 are closely disposed with each other in a second horizontal direction Y perpendicular to both the vertical direction Z and the first horizontal direction X. Understandably, the first spring arm 212 and the second spring arm 222 are partially overlapped with each other in the vertical direction. In detail, the first soldering leg 213 forms a first soldering section 2130, the second soldering section 223 forms a second soldering section 2230, and the first soldering section 2130 and the second soldering section 2230 are coplanar with each other for commonly forming a soldering section/platform on which the solder ball 3 is attached.

To enhance assembling between the primary part 21 and the secondary part 22, the second spring arm 222 is soldered/welded to the first main body 211. The first spring arm 212 includes a bending section 2122 and an oblique section 2123 linked between the bending section 2122 and the contacting section 2121. The second spring arm 222 includes an oblique section 2221 and an abutting section 2222 abutting against the first main body 211.

The primary part 21 is stamped and formed by first sheet metal (not shown) and originally linked to a contact carrier (removed/not shown) via the first connection section 214. Similarly, the secondary part 22 is stamped and formed by second sheet metal (not shown) and originally to a contact carrier (removed/not shown) via the second connecting section 224. In a top view, the passageway 10 forms a Z-shaped configuration with the first connecting section 214 and the second connecting section 224 are located at two opposite ends of the Z-shaped configuration while the first spring arm 212 and the second spring arm 222 are located at a middle region of the Z-shaped configuration.

In this embodiment, the contacting section 2121 may keep the desired resiliency with relatively less width and thickness thereof as used in the conventional design. Different from the conventional design, the invention uses the secondary part 22 to form an additional transmission path between the contacting section 2121 which contacts the CPU 900, and the solder ball 3 which contacts the PCB 910. The secondary part 22 may use material with higher conductivity and thicker/wider configuration, compared with the primary part 21 for not only high power transmission but also reinforcement of the whole contact 2 in the passageway 10. Alternately, the first soldering leg 213 and the second soldering leg 223 may be connected to each other either vertically or sidewardly, and only one of the first soldering leg and the second soldering leg is attached with the solder ball. In brief, in the invention a first transmission path is formed between the solder ball 3 and the contacting section 2121 via the primary part 21, and a second transmission path therebetween mainly via the secondary part 22 which has higher conductivity and/or lower resistance than the primary part 21 electrically.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for connecting between a CPU (Central Processing Unit) and a PCB (Printed Circuit Board) comprising:

an insulative housing defining opposite upper and lower surfaces in a vertical direction;

at least one passageway formed in the housing and extending through both the upper surface and the lower surface in the vertical direction; and at least one contact including a primary part and a secondary part both retained in the passageway, the primary part and the secondary part being discrete from while mechanically and electrically connected to each other; wherein the primary part includes a first spring arm with a contacting section for contacting the CPU, and at least one of the primary part and the secondary part includes a soldering leg with a soldering section with a solder ball thereon for mounting to the PCB;

the secondary part forms a second spring arm contacting the first part; and the primary part includes a planar first main body and the secondary part includes a planar second main body opposite to and spaced apart from the planar first main body in a first horizontal direction perpendicular to the vertical direction.

2. The electrical connector as claimed in claim 1, wherein the first spring arm and the second spring arm are partially overlapped with each other in the vertical direction.

3. The electrical connector as claimed in claim 1, wherein said soldering leg extends in the first horizontal direction.

4. The electrical connector as claimed in claim 3, wherein the other of the primary part and the secondary part forms another soldering leg located beside the soldering leg in a second horizontal direction perpendicular to both the vertical direction and the first horizontal direction so as to cooperate with said soldering section to commonly form a soldering platform on which the solder ball is attached.

5. The electrical connector as claimed in claim 1, wherein the passageway forms a Z-shaped configuration in a top view along the vertical direction.

6. The electrical connector as claimed in claim 1, wherein the secondary part has higher conductivity than the primary part.

7. The electrical connector as claimed in claim 1, wherein the secondary part is thicker than the primary part.

8. The electrical connector as claimed in claim 1, wherein each of the primary part and the secondary part has an upwardly extending connecting section with an upper end terminated at the upper surface for connecting to a contact carrier.

9. An electrical connector for connection between a CPU (Central Processing Unit) and a PCB (Printed Circuit Board), comprising:

an insulative housing defining opposite upper and lower surfaces in a vertical direction;

at least one passageway formed in the housing and extending through both the upper surface and the lower surface in the vertical direction; and at least one contact including a primary part and a secondary part both retained in the passageway, the primary part and the secondary part being discrete from while mechanically and electrically connected to each other; wherein the primary part includes a first spring arm extending above the upper surface with a contacting section for contacting the CPU, and at least one of the primary part and the secondary part includes a mounting leg around the lower surface for mounting to the PCB;

the secondary part forms a second spring arm contacting the first part; and the primary part includes a planar first main body and the secondary part includes a planar second main body opposite to and spaced apart from the planar first main body in a first horizontal direction perpendicular to the vertical direction.

10. The electrical connector as claimed in claim 9, wherein the first paring arm and the second spring arm are partially overlapped with each other in the vertical direction.

11. The electrical connector as claimed in claim 9, wherein the passageway forms a Z-shaped configuration in a top view along the vertical direction.

12. The electrical connector as claimed in claim 9, wherein the secondary part has higher conductivity than the primary part.

13. The electrical connector as claimed in claim 9, wherein the secondary part is thicker than the primary part.

14. An electrical connector for connection between a CPU (Central Processing Unit) and a PCB (Printed Circuit Board), comprising:

an insulative housing defining opposite upper and lower surfaces in a vertical direction;

at least one passageway formed in the housing and extending through both the upper surface and the lower surface in the vertical direction; and at least one contact retained in the passageway and including a primary part and a secondary part mechanically and electrically connected to each other; wherein the contact includes a spring arm extending above the upper surface with a contacting section for connecting to the CPU, and a mounting section around the lower surface for mounting to the PCB; wherein a first transmission path and a second transmission path are formed between the contacting section and the mounting section, the first transmission path has a higher conductivity or a lower resistance than the second transmission path; and the primary part and the secondary part are discrete from each other structurally and differ from each other in thickness and in material.

* * * * *